United States Patent [19]

Malian

[11] Patent Number: 4,610,054

[45] Date of Patent: Sep. 9, 1986

[54] CLIPBOARD WITH RELEASABLE FASTENING MEANS FOR ATTACHMENT OF ACCESSORIES

[76] Inventor: Thomas Malian, 1 Willets Rd., Old Westbury, N.Y. 11568

[21] Appl. No.: 738,221

[22] Filed: May 28, 1985

[51] Int. Cl.[4] ..... B42F 9/00; A47G 29/00

[52] U.S. Cl. ..... 24/67 R; 24/67.11; 248/205.2

[58] Field of Search ..... 24/67 R, 67.11, 67 AR, 24/10 R, 11 HC, 306, 545; 248/205.2, 205.3; 362/99

[56] References Cited

U.S. PATENT DOCUMENTS

| | | | |
|---|---|---|---|
| 216,657 | 6/1879 | Cochrane | 24/67.11 |
| 381,702 | 4/1888 | King | 24/10 R |
| 2,914,873 | 12/1959 | Brennan | 248/205.3 |
| 3,232,685 | 2/1966 | Wilstein et al. | 362/99 |
| 3,297,862 | 1/1967 | Levy et al. | 362/99 |
| 3,309,514 | 3/1967 | Levy et al. | 362/99 |
| 3,387,341 | 6/1968 | Mates et al. | 248/205.2 |
| 3,399,429 | 9/1968 | Goodman | 24/67 AR |
| 4,067,532 | 1/1978 | Viteretto | 248/205.3 |
| 4,330,161 | 5/1982 | Khawand | 248/205.3 |
| 4,401,323 | 8/1983 | Rex | 24/67.11 |

FOREIGN PATENT DOCUMENTS

| | | | |
|---|---|---|---|
| 101042 | 2/1965 | Denmark | 248/205.2 |

*Primary Examiner*—Victor N. Sakran

*Attorney, Agent, or Firm*—Collard, Roe & Galgano

[57] ABSTRACT

A clipboard includes a board having a generally planar front surface divided into two regions, a first region dimensioned to accommodate a writing tablet and a second region dimensioned to accommodate at least one accessory. A clip is secured to the board and disposed adjacent to the first region for releasably clamping a writing tablet to the first region, and a pair of cooperating mechanically interlocking, but releasable, filament-type fastening elements is provided for releasably fastening an accessory to the second region, one of which is affixed to the second region and the other of which is affixable to an accessory.

1 Claim, 5 Drawing Figures

CLIPBOARD WITH RELEASABLE FASTENING MEANS FOR ATTACHMENT OF ACCESSORIES

BACKGROUND OF THE INVENTION

This invention relates to a clipboard capable of holding accessories. More particularly, it relates to a clipboard with hook and loop tape, especially intended for holding accessories such as tape recorders and calculators.

The user of a conventional clipboard must often simultaneously use an accessory too, such as a tape recorder or calculator. With the advent of miniaturized electronic tape recorders, calculators, and other accessories, these items have become easily portable, and their use with a clipboard and writing pad is naturally complementary. However, the user of a clipboard and an accessory often has difficulty in handling both items simultaneously. Frequently, such a user will have limited space in which to work, for example, when he is seated in an aircraft, train, automobile, or especially in a classroom or meeting room environment. Under these circumstances, the accessory most often is held in the user's hand due to lack of workspace. This denies the user the freedom of using both hands. Besides forcing the user into an awkward working posture, hand-held use of an accessory tends to induce fatigue and arm and hand weariness. In addition, if the accessory is a tape recorder, hand-held use generally causes banging and scratching noises on the sound recording, due to the movement of the tape recorder. Further, use of an accessory in a limited space, whether the accessory is in the user's hand, on his lap, or on a cramped working surface, involves a significant risk of damage to the accessory due to bumping or dropping.

In the past, clipboards with attachments have been proposed (U.S. Pat. No. 3,309,514), and the use of hook and loop tape as a means for holding is well known (U.S. Pat. Nos. 3,387,341; 3,128,514; 3,476,304; and 4,391,457). However, so far as is known, no presently available clipboard has been able to have accessories securely yet removably mounted thereon in a facile and simple manner as herein proposed.

It is therefore an object of this invention to provide a clipboard wherein accessories may easily and removably be secured to the clipboard, allowing both the clipboard and the accessories to be readily available to the user.

It is a further object of the invention to provide such a novel clipboard which is of relatively simple construction, inexpensive to manufacture and easy to use.

It is a more particular object of this invention to provide such a novel clipboard wherein the accessories and the clipboard may be handled and carried as a single compact unit with both the accessories and the clipboard writing surface available for immediate use.

SUMMARY OF THE INVENTION

These and other related objects are achieved according to the invention by a board having a generally planar front surface divided into two regions, a first region dimensioned to accommodate a writing tablet and a second region dimensioned to accommodate at least one accessory. A clip secured to the board and disposed adjacent to the first region provides for releasably clamping a writing tablet to the first region. The board also has means for releasably fastening an accessory to the second region, including a pair of cooperating mechanically interlocking filament-type fastening elements, one of which is affixed to the second region and the other of which is affixable to the accessory.

Preferably, the cooperating fastening elements are hook and loop tape. It is also advantageous that the second region be disposed above the first region and that the clip be disposed between the first region and the second region, with the board being generally rectangular in shape. It is also desirable that the loop fastening element be affixed to the second region, although the hook and loop tape may be reversed. Finally, in a preferred embodiment of the invention, a clipboard assembly is provided composed of a clipboard of the type above-described in combination with an accessory releasably fastened thereto, such as a calculator or tape recorder.

BRIEF DESCRIPTION OF THE DRAWINGS

Other objects and features of the present invention will become apparent from the following detailed description taken in connection with the accompanying drawings which disclose one embodiment of the invention. It is to be understood, however, that the drawings are designed for the purpose of illustration only and are not intended as a definition of the limits of the invention.

In the drawings, wherein similar reference characters denote similar elements throughout the several views.

DETAILED DESCRIPTION OF THE PREFERRED EMBODIMENT

Figure 1:
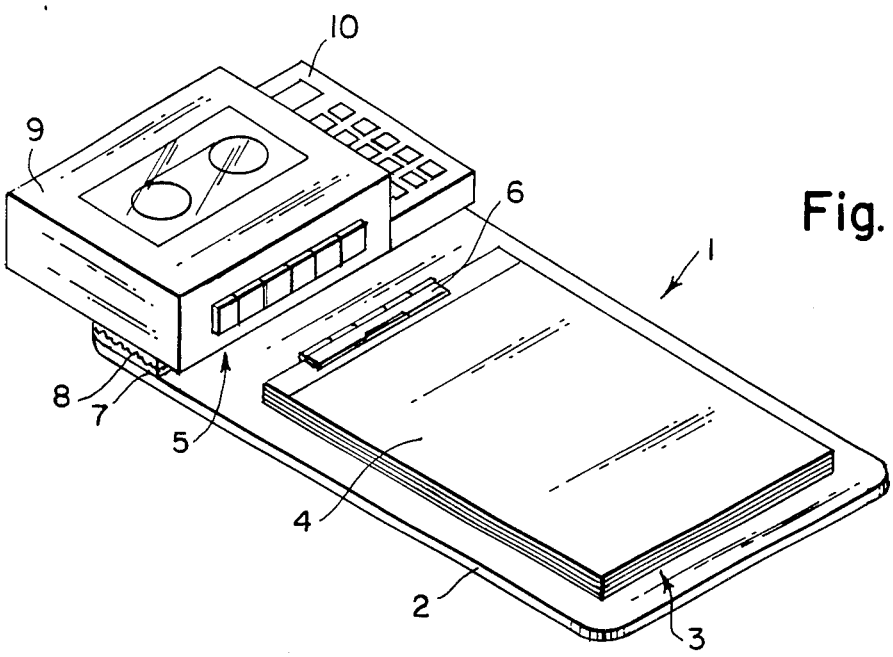
FIG. 1 is a perspective view of an improved clipboard embodying the present invention with a tape recorder and calculator releasably attached thereto.
Figure 2:
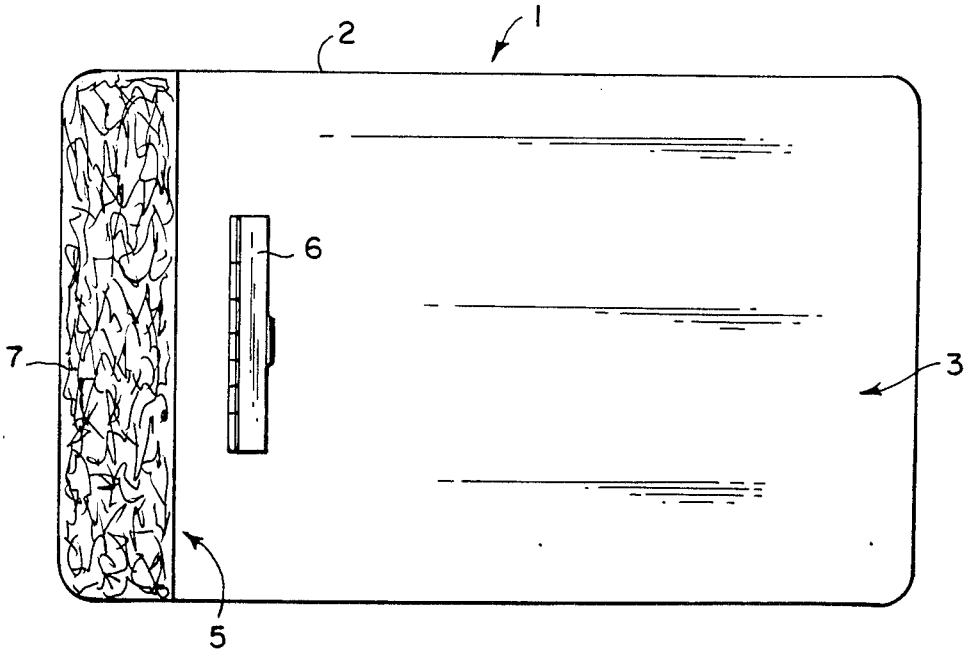
FIG. 2 is a plan view of the clipboard shown in FIG. 1, but without any accessories mounted thereon.

Referring now in detail to the drawings, therein illustrated is a novel clipboard 1 embodying the present invention which, as shown in FIGS. 1 and 2, includes an essentially rectangular board 2 having a generally planar front surface. The front surface is divided into two regions, a relatively large, rectangular first region 3 dimensioned for accommodating a writing tablet 4 or other writing accessories, such as note or sketch pads, etc., and a relatively small, rectangular second region 5 disposed above first region 3 dimensioned for accommodating an accessory. A spring-loaded clip 6 is attached to the upper central area of board 2, between first and second regions 3, 5, for releasably securing writing tablet 4 onto first region 3 of board 2. Accessories may be releasably mounted on second region 5 by means of mechanically interlocking, but releasable, filament-type fastening elements, such as the well known hook and loop tape commonly sold under the trademark "Velcro".

Figure 3:
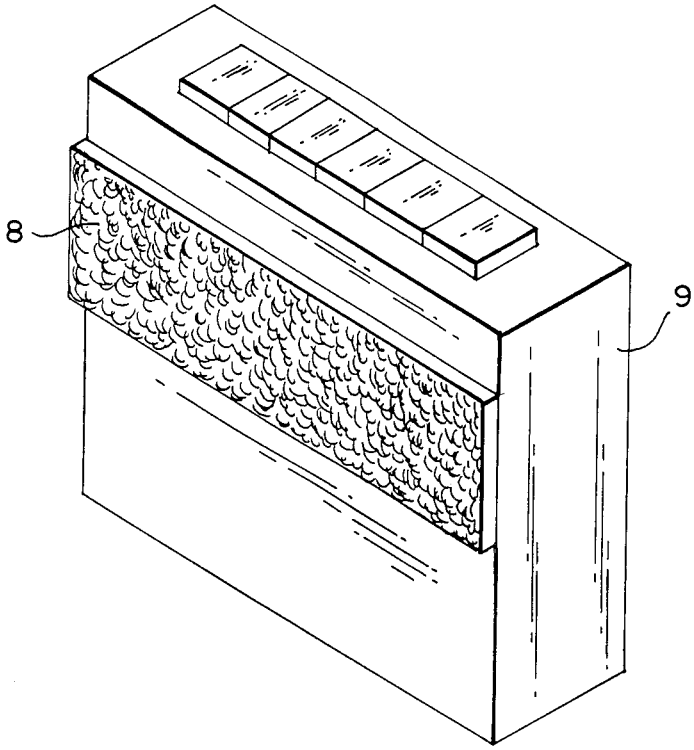
FIG. 3 is a front, side and bottom perspective view of an accessory tape recorder with a hook tape strip attached to the bottom thereof.
Figure 4:
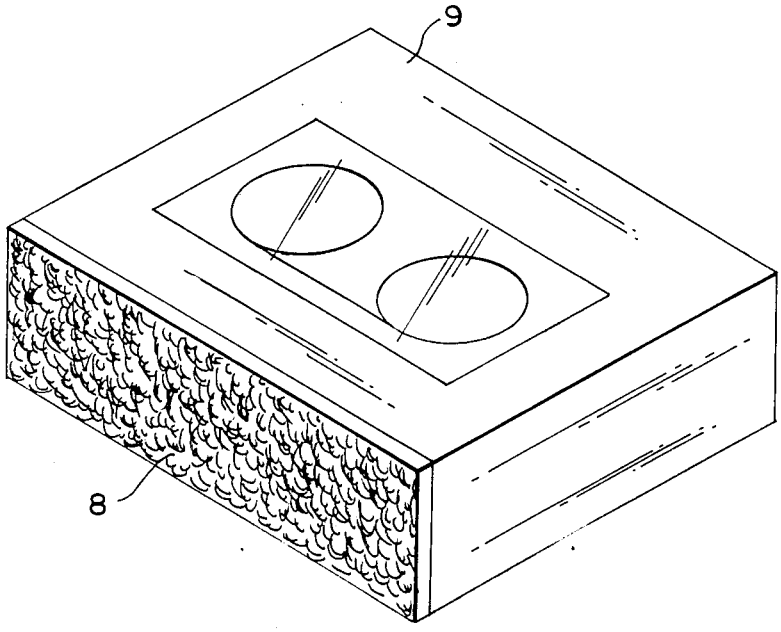
FIG. 4 is a top, side and rear perspective view of an accessory tape recorder with a hook tape strip attached to the rear thereof.
Figure 5:
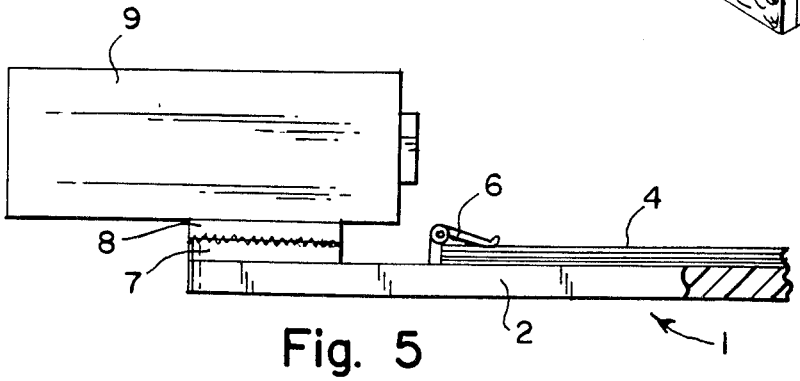
FIG. 5 is a fragmentarily-illustrated, left side elevational view, in part section, of the clipboard and the accessory tape recorder mounted thereon.

As seen best in FIG. 2, a generally rectangular strip of loop tape 7 is adhesively secured to the upper section of board 2 such that it substantially covers second region 5. In a similar fashion, an accessory, such as a miniature tape recorder 9, is provided with a strip of hook tape 8 which may be attached, e.g., to either the bottom (FIG. 3) or rear side (FIG. 4) thereof. This attachment can be implemented by employing adhesive-backed hook tape.

To releasably fasten tape recorder 9 to board 2, tape recorder 9 is positioned over second region 5 such that its strip of hook tape 8 overlies at least a portion of loop tape 7. Hook tape 8 is then pressed onto loop tape 7 with sufficient pressure to effect a mechanical interlocking of the hook and loop fibers of the respective tapes. Other accessories, such as a pocket calculator 10 may also be releasably attached to board 2 in a similar fasion.

In practice, clipboard 1 is provided to the user with a section of loop tape 7 already attached to clipboard 1 therein forming the second region 5 for accommodating accessories 9, 10. A strip of hook tape 8 with an adhesive back is also provided to the user. The user attaches the strip of hook tape 8, using its adhesive back, onto accessory 9, 10 which is to be mounted onto clipboard 1, and then cuts off any excess. The strip of hook tape 8 should be applied to the longest, widest and flatest surface of the accessory 9, 10, which is normally the bottom. By appropriately positioning the strip of hook tape 8, now attached to the accessory 9, 10, onto loop tape 7 of the second region 5, hook tape 8 and loop tape 7 may be mutually engaged, thereby securely mounting accessory 9, 10 to clipboard 1. Release is easily effected in a known manner by first lifting an edge of the accessory from the board, thereby developing a peeling apart action between the hook and loop tape.

Variations may be made as will be apparent to those skilled in the art. For example, in the invention described, the positions of the hook and loop tape could be interchanged. In addition, although the invention as embodied herein describes the accessories as specifically being a tape recorder and a calculator, it would also be possible for other accessories to be used, for example, a stopwatch or drafting tool. Further, although Velcro hook and loop tape is preferably employed, other similar mechanically interlocking but releasable, filament-type fastening means may be employed. It should also be apparent that the clipboard itself may be made of any suitable material such as pressed board, metal or plastic.

Thus, while only one embodiment of the present invention has been shown and described, it will be obvious that many changes and modifications may be made thereunto, without departing from the spirit and scope of the invention.

What is claimed is:

1. A clipboard assembly comprising: a generally rectangular board having a generally planar front surface divided into two regions, a first region dimensioned to accommodate a writing tablet and a second region disposed above said first region dimensioned to accommodate an accessory, said first region being at least twice as large as said second region;

a clip secured to said board and disposed between said first region and said second region adjacent to said first region for releasably clamping a writing tablet to said first region;

at least two accessories; and means for releasably fastening said accessories, in the form of electrical components such as electrical calculator and recorder, to said second region including a pair of cooperating hook and loop tape fastening elements, said loop fastening element being affixed to said second region and said hook fastening element being affixed to said accessory so that the operator's hands can be free to take notes without manipulating said electrical components.

* * * * *